US011957218B1

(12) United States Patent
Sarazin

(10) Patent No.: US 11,957,218 B1
(45) Date of Patent: Apr. 16, 2024

(54) CAM BUCKLE WITH DUAL-WALLED FEED CHANNEL, DUAL-GRIP CAM COVER AND SNAP-LOCK CAM CLOSURE

(71) Applicant: Michael Sarazin, Winnipeg (CA)

(72) Inventor: Michael Sarazin, Winnipeg (CA)

( * ) Notice: Subject to any disclaimer, the term of this patent is extended or adjusted under 35 U.S.C. 154(b) by 0 days.

(21) Appl. No.: 18/502,695

(22) Filed: Nov. 6, 2023

Related U.S. Application Data

(63) Continuation of application No. 18/348,840, filed on Jul. 7, 2023, now abandoned.

(51) Int. Cl.
*A44B 11/10* (2006.01)

(52) U.S. Cl.
CPC ..... *A44B 11/10* (2013.01)

(58) Field of Classification Search
CPC ..... A44B 11/10; A44B 11/12
See application file for complete search history.

(56) References Cited

U.S. PATENT DOCUMENTS 2,981,993 A * 5/1961 Elsner ..... B60P 7/0823 24/193
3,253,309 A 5/1966 Baresch
3,413,691 A 12/1968 Elsner
4,843,688 A 7/1989 Ikeda
4,881,303 A * 11/1989 Martini ..... A44B 11/14 D30/138
5,423,644 A * 6/1995 First, Sr. ..... A44B 11/14 24/68 CD
5,920,963 A * 7/1999 Chou ..... F16G 11/106 24/191
6,665,913 B2 12/2003 Kosh et al.
9,775,410 B2 10/2017 Szewczyk et al.
10,506,853 B2 * 12/2019 Bazin ..... G04B 37/1486
(Continued)

FOREIGN PATENT DOCUMENTS

ES 8700032 11/1985
JP 20000104708 11/2000
(Continued)

OTHER PUBLICATIONS https://web.archive.org/web/20220925174107/https://www.adventurexpert.com/product/adjuster-with-cam/ publication date Sep. 25, 2022.

(Continued)

*Primary Examiner* — Robert Sandy
(74) *Attorney, Agent, or Firm* — Kyle R Satterthwaite; Ryan W Dupuis; Ade & Company Inc.

(57) ABSTRACT

A cam buckle features side walls, a bottom wall spanning therebetween at bottom edges thereof, and a mid wall overlying the bottom wall to cooperatively delimit a strap feed channel therebetween. A rear webbing is fed forwardly through the channel, and then rearwardly back over the mid wall. A cam cover pivotably coupled to the side walls above the mid wall is movable into a closed position holding a top run of the rear webbing. The cam cover has a primary cam-grip lobe, and a second grip ridge for improved holding strength. A snap fit relation between the cam cover and protuberances on the side walls resist inadvertent opening of the buckle. A ramped topside of the bottom wall and curved end of the mid wall cooperatively denote an upturned outlet end of the feed channel for easier grasping and routing of the rear webbing.

20 Claims, 4 Drawing Sheets

(56) References Cited

U.S. PATENT DOCUMENTS

| | | | | |
|---|---|---|---|---|
| 10,918,540 | B2 | 2/2021 | Scheenstra et al. | |
| 11,051,589 | B2 | 7/2021 | Hatcher | |
| 2016/0174665 | A1* | 6/2016 | Kung | A44B 11/12 24/170 |

FOREIGN PATENT DOCUMENTS

| | | |
|---|---|---|
| JP | 2015231776 | 12/2015 |
| WO | 20100087998 | 5/2010 |

OTHER PUBLICATIONS https://web.archive.org/web/20140830221038/https://www.ahh.biz/straps/strap-poly-pro-plastic-cam-lock-buckle.php publication date Aug. 30, 2014.
https://web.archive.org/web/20230201230547/https://learnmyog.com/hardware.html publication date Feb. 1, 2023.
https://www.alibaba.com/product-detail/KJM-POM-Plastic-Ladder-Lock-Tension_1600136875045.html publication date unknown.
http://www.woojinplastic.com/kr/product/view.php?idx=809&part1_idx=31&part_idx=31 publication date unknown.

* cited by examiner

CAM BUCKLE WITH DUAL-WALLED FEED CHANNEL, DUAL-GRIP CAM COVER AND SNAP-LOCK CAM CLOSURE

CROSS-REFERENCE TO RELATED APPLICATIONS

This application is a continuation of U.S. Nonprovisional application Ser. No. 18/348,840, filed Jul. 7, 2023, the entirety of which is incorporated herein by reference.

FIELD OF THE INVENTION

The present invention relates generally to buckles used for adjustment and securement of webbing straps, and more particularly to cam buckles that include a pivotable cam cover closeable atop a webbing strap to impart a frictional hold thereto.

BACKGROUND

Cam buckles of the foregoing type are widely available and usable for various applications involving the use of webbing straps, for example to hold or secure a load for transport, and come in varying styles and grades, including low-cost plastic buckles and higher-grade metallic buckles.

U.S. Pat. No. 6,665,913, assigned to Bodypoint Designs Inc. of Seattle Washington, discloses an example of a cam buckle used as an end-fitting on a strap of webbing, for example for the purpose of strapping a patient into a wheelchair. At least one notable aspect of the Bodypoint design that distinguishes it over other cam buckles is the inclusion of a snap-lock functionality by which inadvertent opening of the cam cover is better prevented. A mounted end of the cam cover is pivotally supported between two sidewalls of the buckle near one end of those sidewalls, and detents are provided on opposing sides of the pivotable cam cover at a free end thereof for snap fit engagement engage with end-notches situated in the two side walls at an opposing end thereof. With the cam cover open, the strap is fed into the buckle from the end thereof at which the cam cover is pivotably supported, along a topside of a bottom wall of the buckle that includes a bumped-out ramp, from which the free end of the strap is wrapped about a slidable cross-bar, and run back out the same end of the buckle from which the free end of the strap was inserted. This routing path of the strap into and out of the same end of the buckle, and around the slidable cross-bar, imparts a direction-reversing fold to the strap where it wraps around the slidable cross-bar. The degree to which the free end of the folded strap is drawn back out from the buckle dictates how much of the strap is folded over itself, thereby adjusting an effective length of the strap. Once the desired effective length is achieved, the cam cover is snapped closed into a position holding the strap in place between the cross-bar and a toothed underside of the cam cover. The bottom wall of the buckle includes a fastener hole for affixation of the buckle to a structure, but also includes an accompanying slot that can receive another webbing strap end, sewn into a closed loop through this slot, to enable formation of a belt.

Despite the notable improvement embodied in the Bodypoint design over other commercially cam buckles, there still remains room and need for improved and alternative designs that can be employed to beneficial use in a variety of webbing strap applications.

SUMMARY OF THE INVENTION

According to a first aspect of the invention, there is provided a cam buckle comprising:

a first side wall and a second side wall offset from one another in a width direction of the cam buckle by an internal width dimension sufficient to accommodate a strap of webbing between said side walls;

a bottom wall spanning said internal width dimension and interconnecting said first and second side walls along bottom edges thereof;

a mid wall also spanning said internal width dimension and interconnecting said first and second side walls at a position overlying said bottom wall in elevationally offset relation thereabove, thereby delimiting a strap feed channel between said bottom wall and said mid-wall through which said strap is feedable in a longitudinal direction of orthogonal relationship to said width direction; and a cam cover pivotably coupled to the two side walls at a pivot point above a topside of the internal mid wall in elevationally opposite relation across the mid wall from the bottom wall, said cam cover being pivotable between a closed securement position operable to hold said strap against said topside of the internal mid wall, once said strap has been fed longitudinally through said strap feed channel and wrapped back over the topside of said mid-wall, and an open position releasing said hold of said strap against said topside of said internal mid-wall.

According to a second aspect of the invention, there is provided a cam buckle comprising:

a first side wall and a second side wall offset from one another in a width direction of the cam buckle by an internal width dimension sufficient to accommodate a strap of webbing between said side walls;

a wrap-around element spanning said internal width dimension and interconnecting said first and second side walls at a location situated intermediately between front and rear ends of the buckle that oppose one another in a longitudinal direction of orthogonal relationship to said width dimension, wherein the strap is wrappable about a front said wrap-around element from an underside thereof to an opposing topside thereof to impart a folded reversal of the strap such that the strap both enters and exits the buckle at the rear end thereof; and a cam cover pivotably coupled to the two side walls at a pivot point elevated above said wrap-around element, said cam cover being pivotable between a closed securement position operable to hold said strap against said topside of the wrap-around element, and an open position releasing said hold of said strap against said topside of the wrap-around element;

wherein said pivot point of the cam cover resides longitudinally nearer to the front of the wrap-around element than to the rear end of the buckle, and in the closed securement position, said cam cover spans longitudinally, from said pivot point, toward the rear end of the buckle.

According to a third aspect of the invention, there is provided a cam buckle comprising:

a first side wall and a second side wall offset from one another in a width direction of the cam buckle by an internal width dimension sufficient to accommodate a strap of webbing between said side walls;

a wrap-around element spanning said internal width dimension and interconnecting said first and second side walls at a location situated intermediately between front and rear ends of the buckle that oppose one another in a longitudinal direction of orthogonal relationship to said width dimension, wherein the strap is wrappable about a front said wrap-around element from an underside thereof to an opposing topside thereof to impart a folded reversal of the strap such that the strap both enters and exits the buckle at the rear end thereof; and a cam cover pivotably coupled to the two side walls at a pivot point elevated above said wrap-around element, said cam cover being pivotable between a closed securement position operable to hold said strap against said topside of the wrap-around element, and an open position releasing said hold of said strap against said topside of the wrap-around element;

wherein at least one of said side walls has a snap-lock protuberance thereon at an inner side thereof that faces the other one of said side walls at an elevation that overlies the cam cover in the closed securement position thereof to resist opening of said cam cover.

BRIEF DESCRIPTION OF THE DRAWINGS

Preferred embodiments of the invention will now be described in conjunction with the accompanying drawings in which.

DETAILED DESCRIPTION

Figure 1:
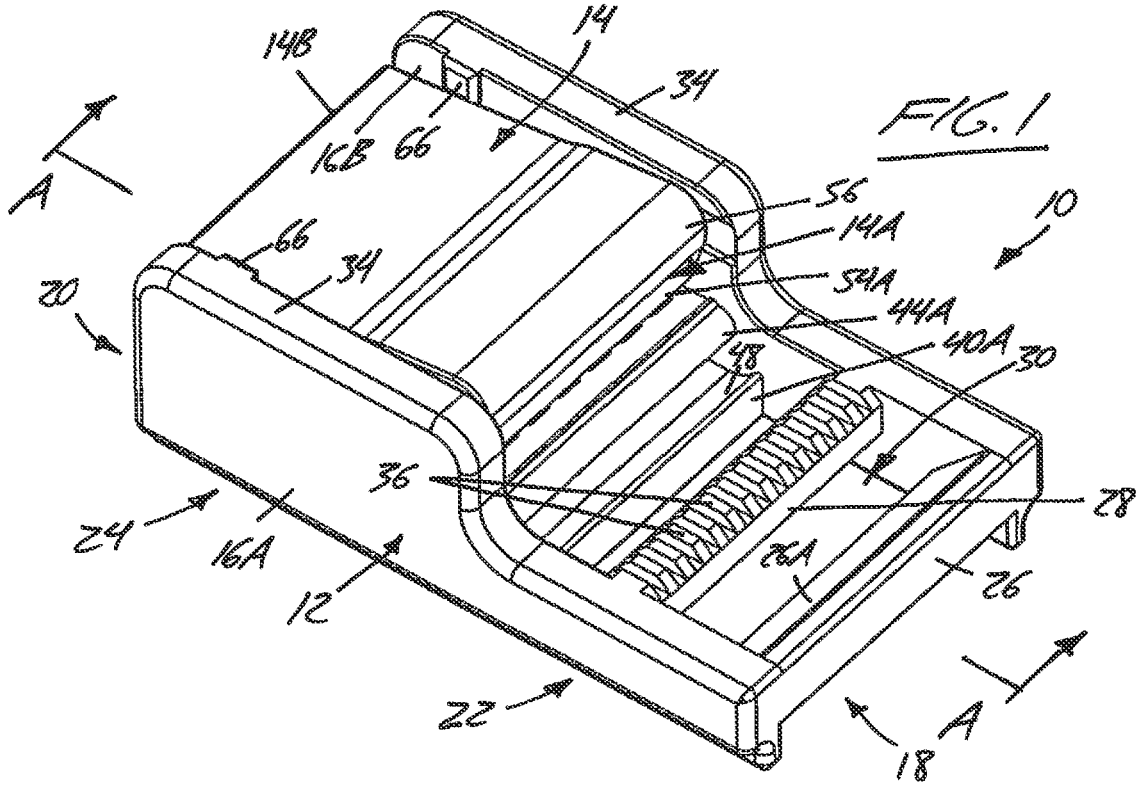
FIG. 1 is a top front perspective view of a novel cam buckle of the present invention, with a cam cover thereof in a closed position.
Figure 2:
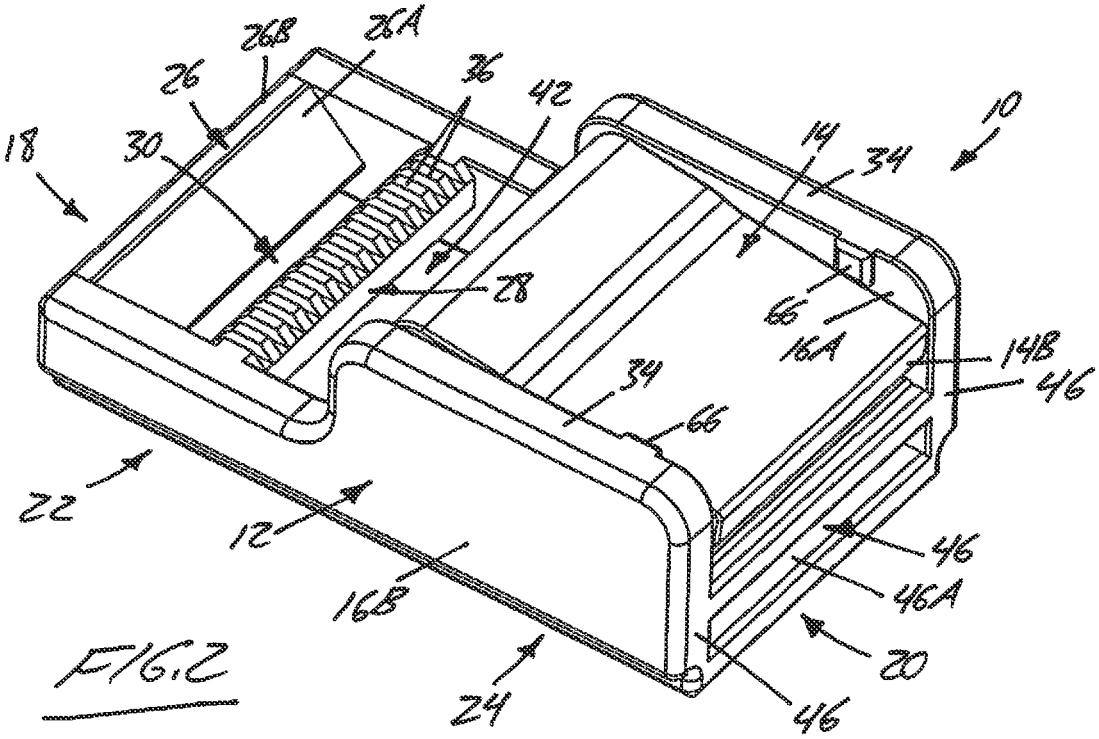
FIG. 2 is a top rear perspective view of the cam buckle of FIG. 1.
Figure 3:
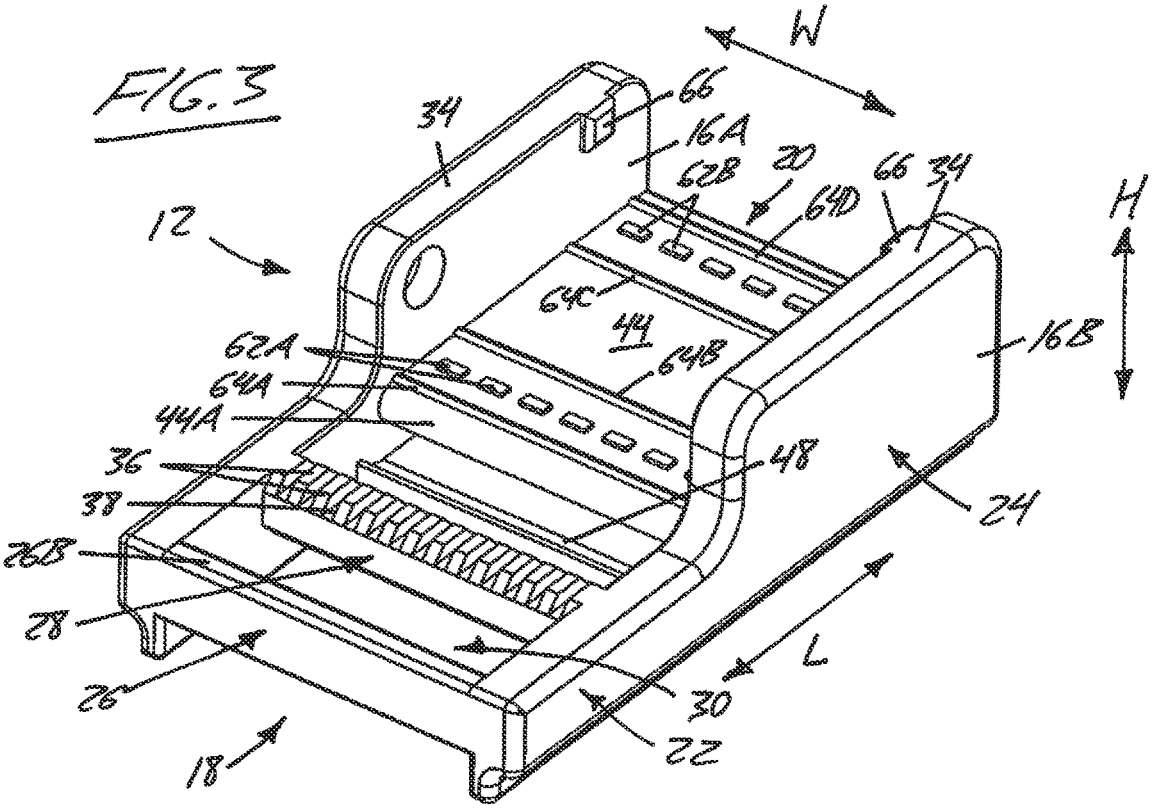
FIG. 3 is a top front perspective view of the cam buckle of FIG. 1 with a cam cover thereof removed for illustrative purpose.
Figure 4:
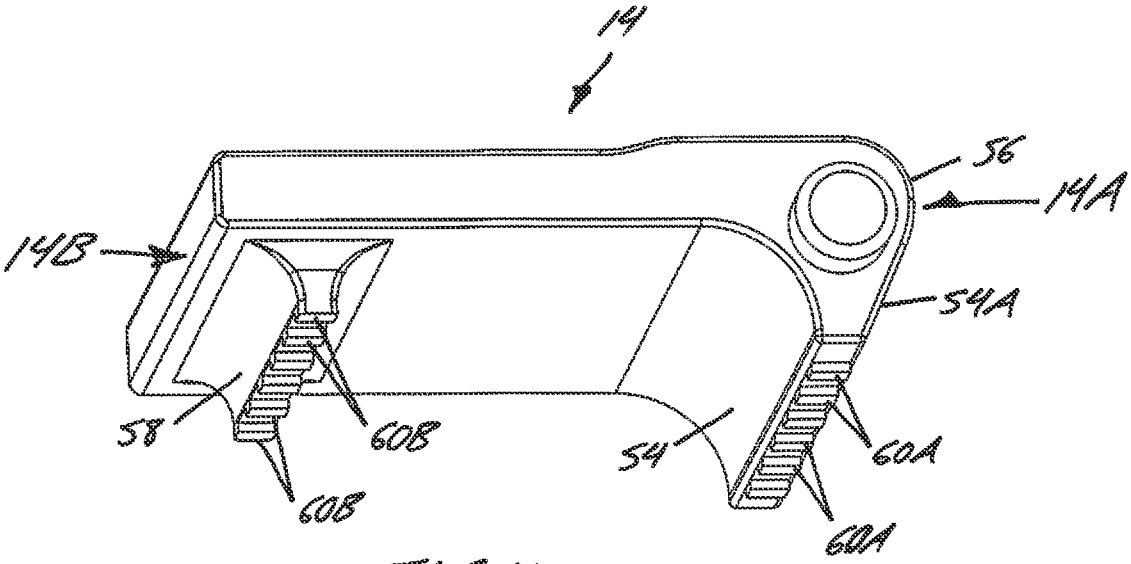
FIG. 4 is a bottom side perspective view of the removed cam cover.
Figure 5:
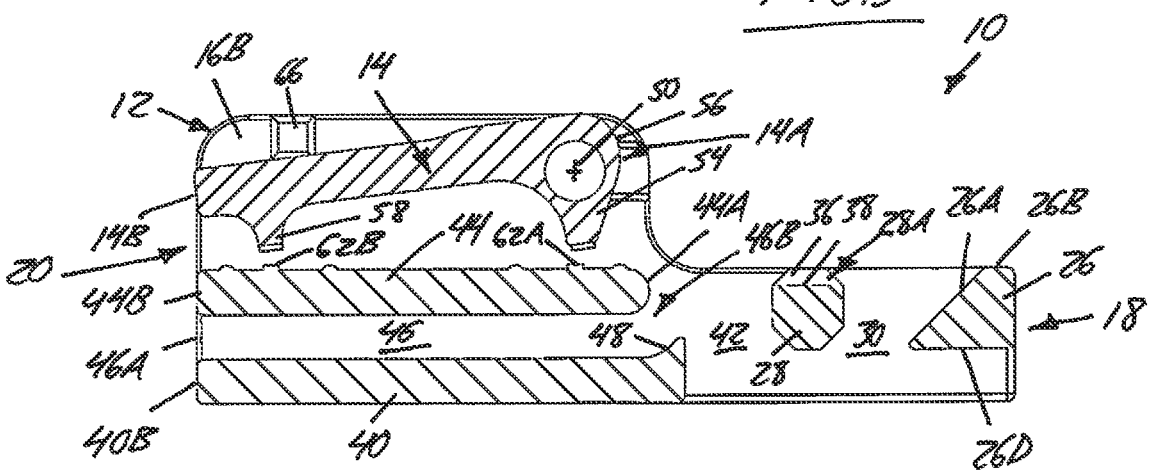
FIG. 5 is a cross-sectional view of the cam buckle of FIG. 1 as viewed along line A-A thereof.

As summarized briefly above, the appended drawings illustrate a novel cam buckle 10 of the present invention that is useful for selectively securing together two ends of one or two straps of webbing, whether that be to secure together the two opposing ends of a singular strap of webbing to form that singular strap into a closed loop, or to secure together two respective ends of two different straps of webbing, for example each of whose other opposing end may be fastened or otherwise anchored to a structure of some sort, depending on a particular application in which the cam buckle 10 is being used. One non-limiting example of a useful application for the novel cam buckle is for cargo hold-down purposes in a truck bed, whether the buckle is used to close a singular webbing strap into a closed loop through a singular anchor point on the truck and around the load, or to interconnect, in a tightenable fashion, two webbing straps that are hooked or otherwise anchored to two respective anchor points on the truck. Similarly, in another non-limiting example of a possible use for the novel cam buckle 10, two such webbing straps respectively anchored to spaced apart points (e.g. wall studs) on a wall structure may be interconnected in tightenable fashion by the novel cam buckle 10, and used to hold an article in a stored position up against the wall, to prevent the article from tipping away from said wall.

The illustrated embodiment of the cam buckle has two main components, a static frame 12 and a movable cam cover 14 pivotably coupled to the static frame 12. The frame comprises first and second side walls 16A, 16B that reside in parallel planes that are spaced apart from one another in a width direction W of the buckle 10, to which a longitudinal direction L of the buckle is orthogonally oriented. A height or elevational direction H denotes a third and final reference direction, and lies orthogonally of the width and longitudinal directions W, L. An internal width of the buckle refers to a dimension measured perpendicularly between the two side walls 16A, 16B in the width direction W, and corresponds closely to the strap width of a particular size of webbing strap for which the buckle is intended for use. From this, it will be appreciated that different models of the buckle 10 may be produced with different respective internal widths intended for different commercially available widths of webbing straps. The two side walls 16A, 16B run longitudinally of the buckle over a full length thereof, from a front end 18 of the buckle 10 to a longitudinally opposing rear end 20 thereof.

In the longitudinal direction L, the buckle 10 can be considered to be composed of two halves: a front half 22 spanning a partial length of the buckle 10 from the front end 18 thereof, and a rear half 24 spanning a remaining partial length of the buckle from the rear end 20 thereof. The term "halves" is used herein in a general sense, two mean two parts of a whole, in this case, two fractional parts of the buckle's overall length, measured longitudinally between the front and rear ends of the buckle, and not to specifically mean that each fraction is exactly 50% of that whole. Each half 22, 24 of the buckle is designed to receive and engage a respective length of webbing, whether those lengths of webbing are respective end-adjacent partial lengths of a singular strap of webbing being formed into a closed loop by the cam buckle 10, or belong to two separate straps of webbing that are being interconnected by the cam buckle 10. For brevity, the respective length of webbing received by the front half 22 of the buckle may be referred to herein as the front webbing, with the other respective length of webbing received by the rear half 24 of the buckle similarly referred to as the rear webbing.

The frame 12 includes a terminal cross-bar 26 that spans the internal width of the buckle 10 at the front end 18 thereof, and perpendicularly interconnects the two side walls 16A, 16B with one another. At a distance spaced longitudinally rearward from the terminal cross-bar 26, but still at the front half 22 of the buckle 10, the frame 12 includes a wrap-around cross-bar 28 that likewise also spans the internal width of the buckle 10 and perpendicularly interconnects the two side walls 16A, 16B. The longitudinal distance between these two cross-bars 26, 28 is less than the internal width of the buckle spanned by those cross-bars 26, 28, thus leaving an open front slot 30 between the two cross-bars 26, 28. In longitudinally oriented cross-sectional planes of parallel relation to the longitudinal and height directions L, H, including a central such longitudinal plane in which the buckle is cross-sectioned FIGS. 5 through 8, the terminal cross-bar 26 has a tapered cross-section that narrows toward the rear end 20 of the buckle, thereby creating a pointed profile at an inner (or rear) side 26A of the terminal cross-bar 26 that faces the wrap-around cross-bar 28 and delimits a front side of the open front slot 30. In the illustrated example, this inner side 26A of the terminal cross-bar 26 is of oblique angulation to the longitudinal and height directions L, H, and more specifically slopes obliquely downward and rearward from a topside 26B of the terminal cross-bar 26. The inner side 26A thus terminates at a pointed bottom tip 26C of the terminal cross-bar 26, where the obliquely sloped inner side 26A of the terminal cross-bar 26 meets with a neighbouring underside 26D of the terminal cross bar 26. At the front half 22 of the buckle 10, the two sidewalls 16A, 16B, which may share an identical shape profile to one another, are shorter in height than they are at the rear half 24 of the buckle 10. The two cross-bars 26, 28 are both shorter in height than the two side walls 16A, 16B, and each reside in elevated relation to the bottom edges 32 of the two side walls 16A, 16B. In the illustrated example, the topside 26B of the terminal cross-bar 26 is at flush elevation with the top edges 34 of the two side walls 16A, 16B.

In the non-limiting context of the illustrated example, a topside 28A of the wrap-around cross-bar 28, instead of having a uniform shape profile over the full internal width of the buckle 10, has a series of ridges 36 and lands 38 arranged in alternating relation to one another across the internal width of the buckle. Of these, the ridges are of raised elevation relative to the intervening lands. This varying top profile of the wrap-around cross-bar 28 is intended to impart frictional gripping effect to the front webbing, when wrapped snugly around the wrap-around cross-bar 28 of the buckle's front half. Also in the interest of imparting functional grip to the front webbing, the wrap-around cross-bar 28 of the illustrated embodiment is polygonal in its cross-sectional profile, for example having an octagonal cross-section at the ridges 36, and a comparably top-truncated hexagonal cross-section at the lands 38, where the top land of the cross-bar is flat, and lies parallel to an imaginary chord that interconnects a second-uppermost pair of vertices of the octagonal cross-section possessed by wrap-around cross-bar 28 at each ridge 36 thereof. As shown, the tops of the ridges 36 may reside at flush elevation with the top edges 34 of the two side walls 16A, 16B, and thus coplanar with the topside 26B of the terminal cross-bar 26. As also shown, the two cross-bars 26, 28 may have flat undersides of coplanar relation to one another at an upwardly offset elevation from the plane occupied by coplanar bottom edges 32 of the two side walls 16A, 16B.

Turning to the rear half 24 of the buckle 10, the frame 12 also includes a bottom wall 40 that spans the internal width of the buckle 10 over a partial length of the two side walls. In the illustrated example, the bottom wall is of greater measure in the longitudinal direction L than in the width direction. The bottom wall 40 runs along the bottom edges 32 thereof starting from a location at or rear the rear end 20 of the buckle. From here, the bottom wall 40 spans longitudinally forward toward the opposing front end 18 of the buckle, but stops notably short thereof, and more specifically, stops short of the wrap-around cross-bar 28 of the buckle's front half, whereby an open middle slot 42 resides in the front half 22 of the buckle between the wrap-around cross-bar 28 and a front end 40A of the bottom wall 40. The "middle" characterization of this slot 42 is not intended to denote that it resides between two other slots, but rather that it resides nearer to a longitudinal center or middle of the buckle than the "front" slot 30 that resides nearer to the front end 18 of the buckle. At a position overlying the bottom wall 40, in elevationally offset relation spaced thereabove, the frame 12 also features a mid wall 44 that likewise spans the internal width of the buckle 10 over a partial length of the two side walls, and likewise starts at or near the rear end of the buckle. As illustrated, the rear end of the buckle may be denoted by a plane shared by coplanar rear edges 46 of the two side walls 16A, 16B. The mid wall 44 runs longitudinally forward from the rear end 20 of the buckle 10, but stops slightly short of the front end 40A of the bottom wall 40. The mid wall 44, which may also be longer than it is wide, is thus slightly shorter than the bottom wall 40, and a front end 44A of the mid wall 44 is offset a short distance longitudinally rearward from the front end 40A of the bottom wall 40.

An opposing rear end 44B of the mid wall 44 overlies a corresponding rear end 40B of the bottom wall 40 at a rear inlet end 46A of a strap feed channel 46 that is bound between the bottom and mid walls 40, 44 and the two side walls 16A, 16B at the rear end of the buckle. A front outlet end 46B of the strap feed channel 46 is denoted by an opening between the front end 44A of the mid wall 44 and an upturned guide ramp 48 found on the topside of the bottom wall 40 at the front end 40A thereof. In the illustrated example, the front end 44A of the mid wall is a convexly rounded edge whose convexity faces forwardly and downwardly toward the guide ramp 48, which in turn has an upwardly concave curvature that faces upwardly and rearwardly toward the rounded front end 44A of the mid wall 44. The front outlet end 46B of the strap feed channel 46 thus has an upturned curvature profile bound between the rounded front end 44A of the mid wall 44 and the upturned guide ramp 48 of the bottom wall 40. The purpose of the guide ramp 48 and the resultingly upturned outlet end 46B of the strap feed channel 46 is to help guide manual wrapping of the rear webbing around the front end 44A of the mid wall 44, after first feeding a free end of the rear webbing through the strap feed channel 46 from the rear inlet end 46A thereof, as described in more detail below.

The cam cover 14 has a cam-lobed end 14A pivotably supported on the two side walls 16A, 16B of the frame 12 at a pivot point 50 spaced elevationally above a topside of the mid wall 44 near the rounded front end 44A thereof, whereby this pivot point 50 resides elevationally across the mid wall 44 from the underlying bottom wall 40 of the buckle 10. Pivot point 50 denotes a pivot axis that perpendicularly intersects the two side walls 16A, 16B near a transitional corner 52 of their shared shape profile, which is where the top edge 34 of each side wall 16A, 16B steps down from the taller rear half of the side wall to the shorter front half thereof. As used herein, an underside of the cam cover 14 refers to a side thereof that faces the mid wall 44 in a closed securement position of the cam cover (FIGS. 1-2, 5 & 8), while a topside of the cam cover refers to an opposing side that faces away from the mid wall 44 in the closed securement position. A free end 14B of the cam cover 14 refers to an end thereof opposite the pivotably supported, cam-lobed end 14A thereof. In the closed securement position, the cam cover spans longitudinally rearward from the pivot point 50, placing the free end 14B of the cam cover 14 at or near the rear end of the buckle 10, at an elevation lesser than that of the taller rear half of each side wall's top edge 34. In the width direction, the cam cover 14 spans a substantial entirety of the internal width of the buckle, as measured between flat areas of the inside surfaces of the two side walls 16A, 16B. The cam cover 14 is of generally flat, plate-like character, with two notable exceptions: the cam-lobed end 14, where the underside of the cam cover has a protrusive primary cam-grip lobe 54 that preferably spans a full width of the cover 14, and a protrusive secondary grip ridge 58 which spans at least a partial width, and preferably at least a majority width, of the cover 14 on the underside thereof at a location nearer to the free end 14B of the cam cover 14.

A camming side 54A of the primary cam-grip lobe 54 faces away from the free end 14B of the cam cover, and joins up with the topside of the cam cover via a rounded corner 55 that arcs around a roughly twelve o'clock to three o'clock quadrant around the pivot axis 50. In this reference frame, twelve and six o'clock reference points are on an axis oriented in the height direction H, and three and nine o'clock reference points are on an axis oriented in the longitudinal direction L. A distal terminus of the primary cam-grip lobe 54, referring to the part of the lobe 54 situated radially furthest from the pivot axis 50, has a set of upper grip teeth 60A thereon at spaced intervals across the width of the cam cover 14. In relation to this set of upper grip teeth 60A, there is provided a corresponding set of lower grip teeth 62A on the topside of the mid wall 44 at spaced intervals across the width thereof at a roughly six o'clock position beneath the pivot axis 50. This toothed are of mid wall may be referred to herein as a front grip area thereof. These lower grip teeth 62A are positioned in staggered relation to the upper grip teeth 60A on the primary cam-grip lobe 54 of the cam cover 14, so that in the closed securement position of the cam cover 14, the lower grip teeth 62A align with the gap spaces between the upper grip teeth 60A. The lower grip teeth 62A below the pivot point 50 may be accompanied by a forwardly neighbouring mini ridge 64A spanning widthwise across the topside of the mid wall 44 at a short distance in front of the lower grip teeth 62A, and/or a rearwardly neighbouring mini ridge 64B likewise spanning widthwise across the topside of the mid wall 44 at a short distance behind the lower grip teeth 62A. Such one or more mini ridges 64A, 64B contribute improved gripping action on the rear webbing when held by the toothed primary cam-grip lobe 54 in the closed securement position of the cam cover 14, and are referred to as mini ridges owing to their lesser stature relative to the more pronounced grip ridge 58 on the cam cover 14.

Like the primary cam-grip lobe 54, the protrusive secondary grip ridge 58 is of protruding relationship to the relatively flat character of a neighbouring region of the cam cover's underside that resides between the primary cam-grip lobe 54 and the secondary grip ridge 58. A distal terminus of the secondary grip ridge 58, referring to the portion thereof situated furthest from the plane of that neighbouring region, like the distal terminus of the primary cam-grip lobe 54, may likewise have another set of upper grip teeth 60B thereon at spaced intervals across the grip ridge 58, in relation to which there is again another corresponding set of lower grip teeth 62B on the topside of the mid wall 44 at spaced intervals across the width thereof at an area thereof that underlies the grip ridge 58 in the closed securement position of the cam cover 14. Again, the upper and lower grip teeth 60B, 62B are of staggered positional relationship to one another in the width direction. Once again, and for the same purpose, the lower grip teeth 62B may be accompanied by a forwardly neighbouring mini ridge 64C spanning widthwise across the topside of the mid wall at a short distance in front of the lower grip teeth 62B, and/or a rearwardly neighbouring mini ridge 64D likewise spanning widthwise across the topside of the mid wall at a short distance behind the lower grip teeth 62B.

To enable snap-lock closure of the cam cover 14 in a manner that resists lifting of the cam cover 14 from it closed securement position (FIGS. 1-2, 5 & 8) to its open release position (FIGS. 6 & 7), the facing-together inside surfaces of the two side walls 16A, 16B each have a respective snap-lock protuberance 66 situated thereon near the rear end 20 of the buckle 10 at an elevation at or near the taller rear half of the side wall's top edge 34. This elevated position of the snap-lock protuberance 66 on each side wall 16A, 16B overlies the cam cover 14, in elevationally opposing relation thereacross from the mid wall 44, in the closed securement position of the cam cover 14. In the closed position shown in FIG. 5, where an edge-adjacent longitudinal margin of the topside of the cam cover 14 at each side thereof is in abutted contact against an underside of the respective snap-lock protuberance 66 of the respective side wall 16A, 16B of the frame 12, the clearance space between the preferably toothed terminus 60B of the secondary grip ridge 58 and the directly underlying, preferably toothed, rear grip area 62B of the of the topside of the mid wall 44 may be roughly, or exactly, equal to the corresponding clearance space between the preferably toothed terminus 60A of the primary cam-grip lobe 54 and the directly underlying, preferably toothed, front grip area 62A of the of the topside of the mid wall 44.

Figure 6:
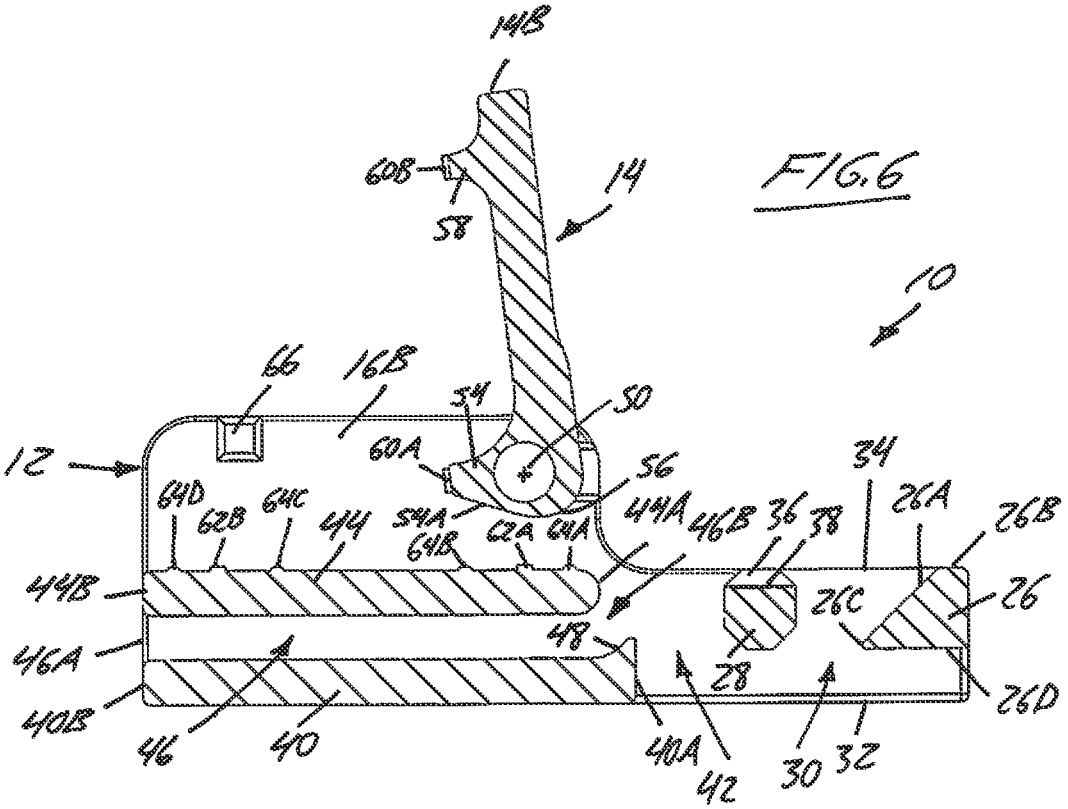
FIG. 6 is another cross-sectional view of the cam buckle of FIG. 5 in the same cross-sectional plane, with the cam cover thereof in an open position.
Figure 7:
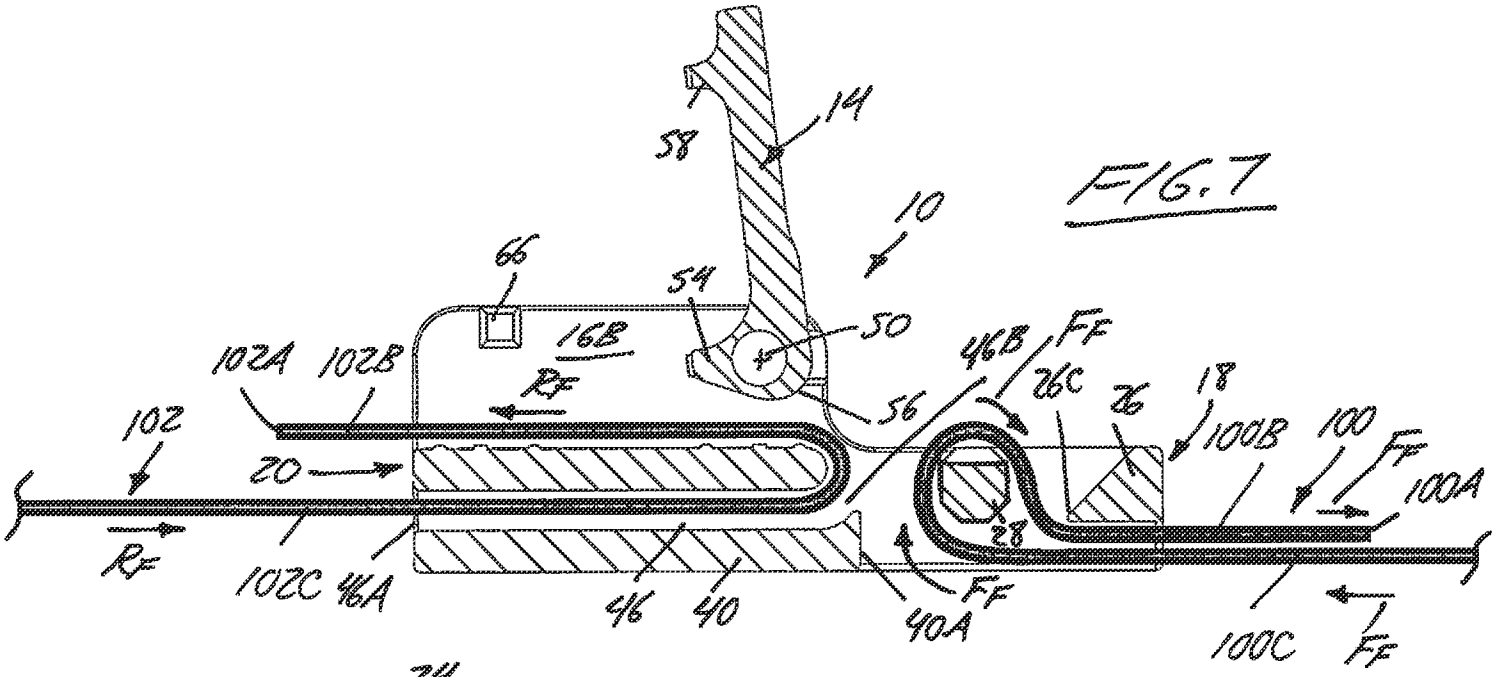
FIG. 7 is another cross-sectional view of the cam buckle of FIG. 6 in the same cross-sectional plane, illustrating threading of two webbing strap ends into the buckle at two opposing ends thereof.
Figure 8:
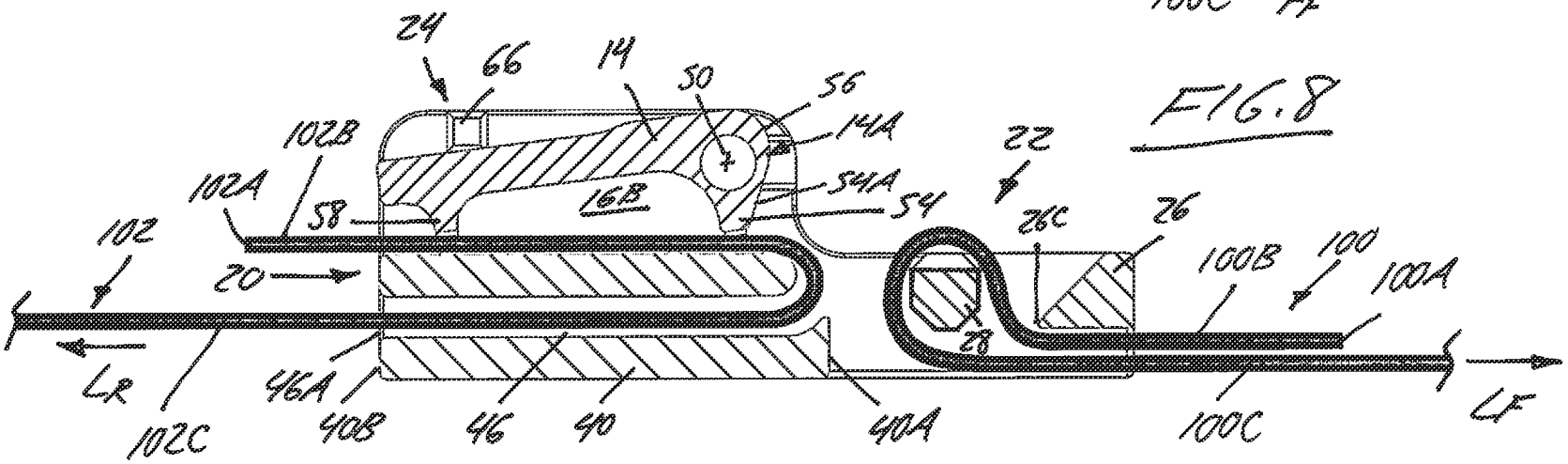
FIG. 8 is another cross-sectional view of the buckle and strap ends of FIG. 7, but with the cam cover closed into a securement position locking the buckle in place on a webbing strap.

Having fully described the structure of the cam buckle 10 in relation to FIGS. 1 through 6, attention is now turned to its use, as illustrated in FIGS. 7 and 8 to couple together front webbing 100 and rear webbing 102, which as referred above, may be embodied as respective partial lengths of a singular webbing strap (that is to be formed into a closed loop by the buckle), or may be embodied in two separate webbing straps (that are to be coupled together by said buckle).

Front webbing 100 is received by the front half 22 of the buckle 10 in a manner removably threaded therethrough, thus omitting need for any sewn closure of this front webbing 100 into a closed-loop, permanent attachment to the buckle, while also allowing effective length adjustment of front webbing 100. That said, it will be appreciated that inventive aspects of the buckle embodied at the rear half thereof may alternatively be used in combination with a differently configured front half that employs other securement or fixation to a front webbing, or that is alternative fastened to a structure of some sort to secure the rear webbing to such structure. Rear webbing 102 is received by the rear half 24 of the buckle 10 in manner also allowing effective length adjustment of the rear webbing 102, and locking thereof at the selected effective length using the cam cover 14.

To thread the front webbing 100 into engagement with the buckle 10, free end 100A of front webbing 100 is manually fed upwardly through the open middle slot 42 in the front half 22 of the buckle 10 from below, and then tucked back downwardly through the open front slot 30. This feeding direction of the front webbing 100 into the buckle is schematically denoted by front feed direction $F_F$ in FIG. 7. Continued feeding of front webbing 100 in this manner up through the middle slot 42 and down through front slot 30, while maintaining slack in the front webbing 100 between the two slots 30, 42, enables adjustment of the effective length of front webbing 100 (i.e. to control how much of the front webbing is folded over itself via wrapped engagement thereof around the wrap-around cross-bar 28). As used herein, the "tails" of a webbing refers to portions of the webbing running out from the buckle 10, as distinctly opposed to an intermediate portion of the webbing that resides between those tails, and in the case of the front webbing 100, is looped around the wrap-around cross-bar 28 of the buckle' front half 22. The tail embodying the free end 100A of the webbing may be referred to as the free tail 100B, and the other tail referred to as the load tail 100C, the latter being that which denotes the effective length of the front webbing and is subjected to load forces during use of the buckle and webbings combination. When feeding the front webbing 100 into the front half 22 of the buckle 10, unilateral pulling of one tail of the front webbing 100 further out from the buckle, without an accompanying feeding of the other tail further into the buckle, for example as may be effected by pulling of both tails 100B, 100C simultaneously, will remove the slack from the intermediate portion of the front webbing, which acts to wrap the intermediate portion of the front webbing 100 tightly around the buckle's wrap-around cross-bar 28. Exertion of a forwardly oriented pulling load $L_F$ on the load tail 100C is frictionally resisted by a combination of a kinked state of the front webbing 100 at the pointed tip 26C of the terminal cross-bar 26, and the adjacently and snugly wrapped state of the front webbing 100 around the wrap-around cross-bar 28. The result is that the effective length of the front webbing 100 will not be reduced by such load force $L_F$ during use of the buckle and webbings combination.

To feed the rear webbing 102 into the rear half 24 of the buckle 10, first, but only if the cam cover 14 is not already open, the cam cover 14 must be lifted out of its closed position at its free end 14B, whether manually or with aid of a prying tool, with sufficient force to overcome the opening resistance provided by the snap-lock protuberances 66, thus lifting the cam cover 14 into an open position. In such open position, the primary cam-grip lobe 54 (and secondary grip ridge 58, in embodiments where included) no longer points downwardly toward the topside of the mid wall 44, and forward example points longitudinally rearward, as shown in FIGS. 6 and 7, or may even point upwardly if the cam cover 14 is rotated further beyond the illustrated open position of those figures, and further toward the front end 18 of the buckle. Once the cam cover 14 is opened in such fashion, free end 102A of the rear webbing 102 is fed into the strap feed channel 46 through the inlet end 46A thereof at the rear end 20 of the buckle 10. This feeding direction of the rear webbing 102 into the buckle is schematically denoted by rear feed direction $R_F$ in FIG. 7

The free end 102A of the rear webbing 102 is fed onward through the strap feed channel 46 to the upturned ramp 48 at the outlet end 46B of the channel 46, where continued feeding of the rear webbing 102 thus imparts an upward travel component to the moving free end 102A of the rear webbing 102, thus guiding same upwardly out from the channel's outlet end 46B above the neighbouring middle slot 42 at the rear end of the buckle's front half 22. This ramp-aided lifting of the rear webbing's front end 102A makes it easier for the user to grasp the emerging free end 102A of the rear webbing 100. Once so grasped, the emerged free end 102A of the rear webbing 102 is then fed back toward the rear end 20 of the buckle 20, this time, outside of the strap feed channel 46, and instead through a gap space between the lobed front end 14A of the cam cover 14 and the front gripping area 62A of the mid wall's topside. This gap space is in an enlarged state at this point in time, owing to the open position of the cam cover 14. The free end 102A of the rear webbing 102 is fed rearwardly onward from this presently enlarged gap space, and along the topside of the mid wall 44, to eventually exit the rear end 20 of the buckle 10 above the rear end 44B of the mid wall and underlying inlet end 46A of the strap feed channel 46. The emergence of the free end 102A of the rear webbing 102 from the rear end 20 of the buckle denotes the free tail 102B of the rear webbing 102, whereas the part of the rear webbing 102 emerging from the rear end 20 of the buckle through the inlet end 46A of the strap feed channel 46 denotes the load tail 102C of the rear webbing. The intermediate portion of the now buckle-threaded rear webbing 102 is wrapped around the mid wall 44 of the inventive buckle 10, instead of around a respective cross-bar thereof.

With the front webbing 100A already engaged tightly with the wrap-around cross-bar 28 at the front half 22 of the buckle, the free tail 102B of the rear webbing 102 is manually pulled, thus drawing more of the rear webbing 102 through the buckle 10, and thereby reducing the effective length (i.e. load tail length) of the rear webbing 102 for tightening effect thereof relative to the load being secured by the webbing strap(s). Once the desired effective length and tightness is achieved, and before releasing the manual pull force on the free tail 102A of the rear webbing 102, the cam cover 14 is moved into its closed position, during which the camming side 54A of the primary cam-grip lobe 54 is brought into contact with the top run of the rear webbing's intermediate portion (i.e. the fraction thereof spanning longitudinally rearward over the topside of the mid wall 44). During this closure of the cam cover 14, the primary cam-grip lobe 54 gradually pushes this top run of the rear webbing 102 in tighter and tighter fashion against the topside of the mid wall 44, owing to the shape of the camming side 54A of the lobe whose radial distance from the pivot point 50 gradually increases in a direction approaching the toothed distal terminus 60A of the primary cam-grip lobe 54. Simultaneously, the same pivotal closure of the cam cover 14 moves the secondary grip ridge 58 gradually closer to the top run of the rear webbing 102 and the underlying mid wall 44, though without exerting a gradually increasing camming force like that being exerted at the cam-lobed front end 14A of the cam cover. Manual closure of the cam cover is effected with sufficient closing force to momentarily deflect the snap-fit protuberances 66 outwardly, in the width direction, for example through momentary flexure of the side walls 16A, 16B, from their default undeflected positions of obstructing/interfering relationship to the cam cover's pivotal movement to momentarily deflected positions in which the cam cover can pass between the protuberances and onward toward the mid wall 44. Upon clearance of the deflected protuberances by the cam cover, the protuberances 66 automatically return to their default undeflected positions, for example under resilient return of the side walls from their momentarily flexed state to a default unflexed state.

Just as the cam cover 14 clears the snap fit protuberances 66, the toothed distal terminus 60A of the primary cam-grip lobe 54 passes by its bottom-dead-center (six o'clock) position of closest adjacency to the topside of the mid wall 44, thus denoting achievement of a past-center cam-locked state of the cam cover 14. At the same time as this snapped closure of the cam cover 14 achieves the past-center cam-locked state, the secondary grip ridge 58 reaches its equal or comparable proximity to the topside of the mid wall 44, thereby applying a supplemental hold force on the top run of the rear webbing 102 at a location of longitudinally rearward distance from the primary holding force exerted thereon by the primary cam-grip lobe 54. In this locked state, exertion of a rearwardly directed pulling load $L_R$ on the load tail 102C of the rear webbing 102 only acts to increase the supplemental hold force exerted by the secondary grip ridge 58. Meanwhile, the inclusion of the snap-lock protuberances 66 increases the resistance to inadvertent opening of the cam cover 14, which again requires manipulation of the cam cover 14 with sufficient force to momentarily deflect the snap lock protuberances 66, beyond the opening resistance that would be provided alone by the past-center cam-locked state at the cam-lobed front end 14A of the cam cover 14. Plastic prototypes of the cam buckle 10 have been produced using 3D printed fabrication of the frame 12 and cam cover 14, but metallic embodiments may also be produced using different fabrication techniques, with metal walls of sufficient flexibility to permit the momentary deflection of the snap fit protuberances, in embodiments in which they are included.

Since various modifications can be made in my invention as herein above described, and many apparently widely different embodiments of same made, it is intended that all matter contained in the accompanying specification shall be interpreted as illustrative only and not in a limiting sense.

The invention claimed is:

1. A cam buckle comprising:

a first side wall and a second side wall offset from one another in a width direction of the cam buckle by an internal width dimension sufficient to accommodate a strap of webbing between said side walls;

a bottom wall spanning said internal width dimension and interconnecting said first and second side walls along bottom edges thereof;

a mid wall also spanning said internal width dimension and interconnecting said first and second side walls at a position overlying said bottom wall in elevationally offset relation thereabove, thereby delimiting a strap feed channel between said bottom wall and said mid-wall through which said strap is feedable in a longitudinal direction of orthogonal relationship to said width direction; and a cam cover pivotably coupled to the two side walls at a pivot point above a topside of the internal mid wall in elevationally opposite relation across the mid wall from the bottom wall, said cam cover being pivotable between a closed securement position operable to hold said strap against said topside of the internal mid wall, once said strap has been fed longitudinally through said strap feed channel and wrapped back over the topside of said mid-wall, and an open position releasing said hold of said strap against said topside of said internal mid-wall.

2. The cam buckle of claim 1 wherein said channel has an inlet end through which said strap is inserted into and through the strap feed channel from outside the buckle, and an outlet end where said strap is reversed back toward said inlet end in external relation to the strap feed channel at the topside of the mid wall, and the cam cover is pivotably coupled to the side walls at a location nearer to the outlet end than to the inlet end.

3. The cam buckle of claim 2 wherein the cam cover, in the closed securement position thereof, spans longitudinally, from said pivot point, toward the inlet end of the strap feed channel.

4. The cam buckle of claim 1 wherein at least one of said side walls has a snap-lock protuberance thereon at an inner side thereof that faces the other one of said side walls at an elevation that overlies the cam cover, in opposing relation thereacross from the mid wall, in the closed securement position of said cam cover to resist opening thereof.

5. The cam buckle of claim 1 wherein said bottom wall, at an outlet end of the strap feed channel, where the strap is reversed back toward an opposing inlet end of the feed channel in external relation thereto at the topside of the mid wall, terminates in an upturned guide ramp that imparts a lifting action to a terminal end of the strap when fed through the strap feed channel from the inlet end thereof.

6. The cam buckle of claim 5 wherein the mid wall, at the outlet end of the strap feed channel, has a convexly rounded end that whose convexity faces toward said guide ramp.

7. The cam buckle of claim 5 wherein said guide ramp possesses a concave curvature that faces toward the mid wall.

8. The cam buckle of claim 1 wherein the cam cover comprises a first gripping region and a second gripping region of which the first gripping region resides nearer to the pivot point of the cam lever than the second gripping region, whereby the two gripping regions of the cam cover overlie discretely different, and longitudinally spaced, regions of the topside of the mid wall in the closed securement position of the cover.

9. The cam buckle of claim 8 wherein the first gripping region resides at a cam lobed end of the cam cover of adjacent relation to the pivot point, and the second gripping region resides at a localized protuberance on an underside of the cam cover that faces the topside of the mid wall in the closed securement position of said cam cover.

10. The cam buckle of claim 8 wherein at least one of the gripping regions on the cam cover, and a respective one of the discretely different regions of the topside of the mid wall, are characterized by a set of upper teeth on said one of the gripping regions of the cam cover and a set of lower teeth on said respective one of the of the discretely different regions of the topside of the mid wall, and said upper and lower teeth are of staggered positional relationship to one another in the width direction.

11. The cam buckle of claim 1 wherein said feed channel has an inlet end through which said strap is inserted into and through the strap feed channel from outside the buckle, and an outlet end where said strap is reversed back toward said inlet end in external relation to the strap feed channel at the topside of the mid wall, the side walls extend beyond the outlet end of the feed channel, and the buckle further comprises:

a wrap-around cross-bar spanning between the first and second side walls at a position spaced longitudinally beyond said outlet end of the inlet channel; and a second cross-bar also spanning between the first and second side walls at a position spaced longitudinally across the wrap-around cross-bar from the outlet end of the inlet channel.

12. The cam buckle of claim 11 wherein the second cross-bar has a tapered cross-section imparting a pointed profile shape at an inner side thereof that faces the wrap-around cross-bar.

13. The cam buckle of claim 11 wherein the wrap-around and second cross-bars reside at positions of elevated relation to the bottom wall.

14. The cam buckle of claim 13 wherein at least one of the wrap-around and second cross-bars is elevationally thicker than the bottom wall.

15. The cam buckle of claim 13 wherein both of the wrap-around and second cross-bars are elevationally thicker than the bottom wall.

16. The cam buckle of claim 13 wherein the wrap-around cross bar has a polygonal cross-section characterized by more than four sides.

17. The cam buckle of claim 13 wherein the wrap-around cross bar has a series of ridges and lands arranged in alternating relation to one another in the width direction of the buckle at a topside of the wrap-around cross bar.

18. A cam buckle comprising:

a first side wall and a second side wall offset from one another in a width direction of the cam buckle by an internal width dimension sufficient to accommodate a strap of webbing between said side walls;

a wrap-around element spanning said internal width dimension and interconnecting said first and second side walls at a location situated intermediately between front and rear ends of the buckle that oppose one another in a longitudinal direction of orthogonal relationship to said width dimension, wherein the strap is wrappable about a front of said wrap-around element from an underside thereof to an opposing topside thereof to impart a folded reversal of the strap such that the strap both enters and exits the buckle at the rear end thereof; and a cam cover pivotably coupled to the two side walls at a pivot point elevated above said wrap-around element, said cam cover being pivotable between a closed securement position operable to hold said strap against said topside of the wrap-around element, and an open position releasing said hold of said strap against said topside of the wrap-around element;

wherein the cam cover has first and second gripping regions characterized by protrusive features for imparting hold to the strap, in a wrapped state thereof around the front of the wrap-around element, when the cam cover is in the closed securement position, of which the first gripping region is nearer to the pivot point of the cam cover than the second gripping region, whereby the first and second gripping regions, in the closed position of the cam cover, impart said hold to the strap at different respective positions thereon of longitudinally spaced relation to one another along a length of said strap to increase an overall hold exerted thereon.

19. The cam buckle of claim 18 wherein said wrap-around element is a mid-wall spanning the internal width of the buckle between the side walls and running longitudinally thereof, and the front of said wrap-around element is a terminal front edge of said mid-wall, whereby the two gripping regions of the cam cover impart said hold to the strap at discretely different, and longitudinally spaced, regions of the topside of the mid wall in the closed securement position of the cam cover.

20. A cam buckle comprising:

a first side wall and a second side wall offset from one another in a width direction of the cam buckle by an internal width dimension sufficient to accommodate a strap of webbing between said side walls;

a wrap-around element spanning said internal width dimension and interconnecting said first and second side walls at a location situated intermediately between front and rear ends of the buckle that oppose one another in a longitudinal direction of orthogonal relationship to said width dimension, where the strap is wrappable about a front of said wrap-around element from an underside thereof to an opposing topside thereof to impart a folded longitudinally-directional reversal of the strap such that the strap both enters and exits the buckle at the rear end thereof;

a cam cover pivotably coupled to the two side walls at a pivot point elevated above said wrap-around element, said cam cover being pivotable between a closed securement position operable to hold said strap against said topside of the wrap-around element, and an open position releasing said hold of said strap against said topside of the wrap-around element; and wherein at least one of said side walls has a snap-lock protuberance thereon at an inner side thereof that faces the other one of said side walls at an elevation that overlies the cam cover in the closed securement position thereof to resist opening of said cam cover.

* * * * *